US007320171B2

(12) United States Patent
Jöllenbeck et al.

(10) Patent No.: US 7,320,171 B2
(45) Date of Patent: Jan. 22, 2008

(54) FUSE COMPONENT

(75) Inventors: André Jöllenbeck, Bochum (DE); Frank Althoff, Hamm (DE); Karin Koch, Witten (DE); Ute Lehnhardt, Bochum (DE)

(73) Assignee: Wickmann-Werke GmbH, Witten (DE)

( * ) Notice: Subject to any disclaimer, the term of this patent is extended or adjusted under 35 U.S.C. 154(b) by 303 days.

(21) Appl. No.: 10/469,292

(22) PCT Filed: Mar. 4, 2002

(86) PCT No.: PCT/EP02/02347

§ 371 (c)(1),
(2), (4) Date: Jan. 8, 2004

(87) PCT Pub. No.: WO02/071432

PCT Pub. Date: Sep. 12, 2002

(65) Prior Publication Data

US 2004/0104801 A1 Jun. 3, 2004

(30) Foreign Application Priority Data

Mar. 2, 2001 (DE) ..... 101 10 199

(51) Int. Cl.
*H01H 69/02* (2006.01)
*H01H 85/055* (2006.01)
*H01H 85/157* (2006.01)

(52) U.S. Cl. ..... 29/623; 337/187; 337/248; 337/158; 337/159; 337/228

(58) Field of Classification Search ..... 337/187, 337/158, 159, 228, 248; 29/623
See application file for complete search history.

(56) References Cited

U.S. PATENT DOCUMENTS 3,333,336 A * 8/1967 Cameron et al. ..... 29/623

(Continued)

FOREIGN PATENT DOCUMENTS

DE 2 330 894 1/1974

(Continued)

*Primary Examiner*—Anatoly Vortman
(74) *Attorney, Agent, or Firm*—Bell, Boyd & Lloyd LLP

(57) ABSTRACT

A fuse component (1) includes a hollow body (2) which is formed from a tubular wall that encloses an inner area (5) and which has two open faces that are situated opposite one another. The fuse component also includes a fuse-element (4) which extends inside the inner area (5) between both faces of the hollow body (2) and two contact caps (3) each provided with a bottom (7) and lateral walls (8) connected thereto. Two end section (10) of a conductor of the fuse-element (4) are led out of the inner area (5) through the faces and around the wall of the hollow body (2). The end sections (10) of the conductor of the fuse element (4) are fastened by an adhesive bond (11) so that the surfaces abutting the inner area (5) are essentially free from organic materials. The end sections (10) of the conductor are preferably fastened to a conductive plastic that, in turn, fastens the contact caps (3) to the outer wall (9) of the hollow body (2).

6 Claims, 1 Drawing Sheet

U.S. PATENT DOCUMENTS

| | | | | | |
|---|---|---|---|---|---|
| 3,460,086 | A | * | 8/1969 | Fister | 337/202 |
| 3,783,506 | A | | 1/1974 | Rehfeld | |
| 3,858,142 | A | * | 12/1974 | Deelman et al. | 337/152 |
| 4,326,185 | A | | 4/1982 | Arikawa | |
| 4,409,729 | A | | 10/1983 | Shah | |
| 4,656,453 | A | * | 4/1987 | Reeder | 337/236 |
| 4,680,567 | A | * | 7/1987 | Edwards | 337/164 |
| 4,684,915 | A | * | 8/1987 | Knapp, Jr. | 337/276 |
| 4,899,123 | A | | 2/1990 | Asdollahi et al. | |
| 4,918,420 | A | * | 4/1990 | Sexton | 337/205 |
| 4,920,327 | A | | 4/1990 | Arikawa et al. | |
| 4,972,169 | A | * | 11/1990 | Kalra | 337/163 |
| 5,642,090 | A | | 6/1997 | Arikawa | |
| 5,726,620 | A | | 3/1998 | Arikawa | |
| 5,926,084 | A | * | 7/1999 | Frochte | 337/231 |
| 5,994,994 | A | * | 11/1999 | Ito et al. | 337/248 |
| 6,147,585 | A | * | 11/2000 | Kalra et al. | 337/248 |
| 6,191,678 | B1 | * | 2/2001 | Edwards | 337/163 |
| 6,798,330 | B2 | * | 9/2004 | Arikawa et al. | 337/231 |

FOREIGN PATENT DOCUMENTS

| | | |
|---|---|---|
| DE | 32 04 241 | 11/1982 |
| DE | 38 33 329 | 4/1989 |
| DE | 37 42 532 | 6/1989 |
| DE | G 92 06 792.1 | 8/1992 |
| DE | G 92 06 798.1 | 8/1992 |
| DE | 4419 055 | 12/1994 |
| DE | 297 09 363 U1 | 12/1997 |
| EP | 0 822 568 | 2/1998 |
| WO | WO 94/03915 | 2/1994 |
| WO | WO 98/34263 | 8/1998 |

* cited by examiner

A–A

FUSE COMPONENT

BACKGROUND OF THE INVENTION

The invention relates to a fuse element including a hollow body, which is constituted by a tubular wall surrounding an internal space and has two opposed open end faces, a fusible conductive element, which extends in the internal space between the two end faces of the hollow body, and two contact caps with a respective base and adjoining side walls, the bases of two contact caps at least partially closing the internal space at the end faces and the side walls overlapping a respective section of the outer surface of the wall of the hollow body, whereby two end sections of a conductor of the fusible conductive element extend out of the internal space through the end faces around the wall of the hollow body so that they are arranged between a respective side wall of one of the contact caps and a section of the outer surface of the hollow body. The invention further relates to a method of manufacturing a fuse element.

A fuse element of the type referred to above has been known for a long time from the prior art. In a known element, the hollow body is for instance, a small glass tube with an internal space of circular cross-section. Extending within the internal space is a fusible wire, the ends of the wire being bent around the ends of the small tube beyond the end faces. Pushed onto the ends of the tube are metallic contact caps such that they are retained in position on the ends of the tube in a force-locking manner and thus clamp the fusible wire between the outer wall of the tube and the inner wall of the caps. The ends of the fusible wire can also be soldered into the caps. These fuses, which have long been known, have, for instance a length of ca. 20 mm, whereby the metal caps positioned on both sides can have an external diameter of ca. 5 mm and a length of ca. 6 mm. Such fuses are commonly inserted or screwed into correspondingly shaped casings.

Starting from this very old prior art, which is widely used in electronic devices, e.g. radio and television receivers, a series of further fuse elements were developed for more recent and more special applications. Fuse elements with considerably reduced dimensions, amongst other things, were developed for applications in which only a small installation space is available. For instance, there are fuses in which a fusible conductor extends within the cylindrical internal space of a small ceramic tube of less than 10 mm length.

If a fusible conductor is subjected for a predetermined minimum period of time to a sufficiently large current, it melts. The current flow is thus supposed to be interrupted. However, when the fusible conductor melts, depending on the applied voltage and the current driving ability of the circuit, in which the fuse is inserted, an arc can form between the end contacts, that is to say between the contact caps of the fuse element, which enables the continued flow of power. Manufacturers of fuse elements are anxious to suppress the formation of such an arc or to limit the time of current flow rendered possible by the arc. Particularly when an alternating voltage is applied to the fuse element, the formation of a new arc in the event of a melted fusible conductor, and after the voltage has passed one or more times through zero, is to be avoided or reduced.

Therefore, the object of the invention is to provide a fuse element of the type referred to above which exhibits a minimal tendency to maintain an arc after melting of the fusible conductor, even if it is of relatively small size.

BRIEF SUMMARY OF THE INVENTION

This object is solved in accordance with the invention by a method of manufacturing a fuse element including the following steps: providing a hollow body, which is constituted by a tubular wall surrounding an internal space and having two opposing open end faces, introducing a fusible element into the internal space of the hollow body such that the fusible conductive element extends substantially from one end face to the other, passing two end sections of a conductor of the fusible conductive element out of the internal space through the end faces around the wall of the hollow body such that they are disposed externally at a respective adhesive point on the outer surface of the hollow body such that a respective portion of the end sections of the conductor of the fusible conductive element is also wetted, positioning two contact caps with a respective base and adjoining side walls on the hollow body such that the bases of the two contact caps at least partially close the internal space at the end faces and the side walls overlap a respective section of the outer surface of the wall of the hollow body, the sections enclosing the two adhesive points, said step of applying the adhesive to the outer surface of the hollow body and the following step of positioning contact caps are carried out so that the adhesive is distributed between the contact cap and the hollow body such that substantially no adhesive gets onto the end faces of the hollow body and into internal space, setting the adhesive, whereby the end sections of the conductor of the fusible conductive element are secured outside the internal space in a gap-shaped space defined between the outer surface and side wall such that the surfaces adjoining the internal space are maintained substantially free of organic materials.

In accordance with the invention, the end sections of the conductor of the fusible conductor element in the fuse element of the type referred to above are secured outside the internal space in a respective gap shaped space defined between the outer surface of the hollow body and the side wall of one of the contact caps by an adhesive connection so that the surfaces adjoining the internal space are substantially free of organic materials. The invention is based on the recognition that the presence of organic materials (i.e. carbon-containing materials) in the interior of the fuse element increases the tendency to sustain an arc. The organic materials originate, for instance from fluxes, which are used in the production of soldered connections between the fusible conductor and the contact caps. Furthermore, organic materials could originate from adhesive, which would always be present in the internal space on the base of the contact caps if the entire contact cap were filled with adhesive and positioned on the end of the tube. In accordance with the invention, the adhesive connection is produced only in the gap shaped space (present as a result of the clearance) between the contact cap and the outer surface of the hollow body. This enables the base of the contact cap to be kept free of all organic adhesive components. The adhesive connection preferably has a sufficient distance from the edge of the hollow body (e.g. tube) directed towards the cap base. The internal space remains "substantially" free of organic adhesive components, which means that potential small residual amounts of adhesive discharging into the internal space at the gap between the edge of the tube and the inner wall of the contact cap should be ignored.

The term small tube in the context of this disclosure should be understood as meaning not only a small tube with a cylindrical cross-section, or a constant cross-section over its length or with an internal space extending in a straight line, although these embodiments are preferred. The fusible conductive element can be, for instance, a simple fusible wire, a fusible wire wound about a core or a carrier element coated with a fusible conductive layer, whereby the core or the carrier or the simple fusible wire preferably extend in a straight line within the internal space in the hollow body. A contact cap in the context of this description is to be understood not only as a metallic contact cap with a flat base and adjoining cylindrical side wall. The contact cap could also have a base which closes the open end face of the hollow body only in part. The side wall also does not need to engage uniformly around the outer surface of the hollow body over the entire periphery; it is merely required that at least one side wall of the contact cap overlaps a section of the outer surface of the wall of the hollow body, an end section of the fusible conductor being arranged in this overlapping section and an adhesive connection being produced at least at that point. The adhesive connection serves to secure the end section of the fusible conductor; it does, however, not need in every case to act as an electrical contact of the fusible conductor. The electrical contact to the fusible conductor can also be produced by mechanically pressing against the contact cap.

In the method of manufacture in accordance with the invention, a hollow body is firstly provided, which is constituted by a tubular wall surrounding a void and has two opposed open end faces ("opposed" in the context of this disclosure does not mean necessarily that the end faces lie in parallel planes; the end faces could, for instance, terminate a curved tube of variable cross section). A fusible conductive element is introduced into this hollow body in such a manner that the fusible conductive element extends substantially from one end to face to the other. Two end sections of a conductor of the fusible conductive element extend out of the void through the end faces around the wall of the hollow body such that they are arranged externally at a respective adhesive point on the outer surface of the hollow body. An adhesive is applied to at least the two adhesive points on the outer surface of the hollow body such that a portion of each of the end sections of the conductor of the fusible conductive element is also wetted. Two contact caps with respective bases and adjoining side walls are then placed on the hollow body such that the bases of the two contact caps at least partially close the void at the end faces and the side walls overlap a respective section of the outer surface of the wall of the hollow body, the sections enclosing the two adhesive points. The adhesive subsequently sets. The end sections of the fusible conductive element are thus secured outside the void by an adhesive connection in a gap-shaped space defined between the outer surface and the side wall such that the surfaces adjoining the void are maintained substantially free of organic materials.

The element in accordance with the invention and an element produced by the method in accordance with the invention has a series of advantages. The use of an adhesive connection to secure the end sections of the fusible conductive element enables solder connections to be dispensed with in the element. This in turn facilitates the installation of the fuse element into the circuit in which it is to be used by its soldered connections, such as an SMD assembly, since the thermal stressing of the fuse element during its installation into a circuit cannot result in softening, loosening or release of the connections present in the element. In addition to the advantage referred to above of avoiding an (organic) flux, the absence of a solder connection in the fuse element has the further advantage of the manufacturability of a lead-free fuse element. In order to avoid flux residues in the fuse element, the prior art proposed complicated flux-free solder connections, special small ceramic tubes, a special pretreatment of the end sections of the small ceramic tubes and complicated layer construction method steps for producing the solder connection, which results in an increase in price of the element, they are necessary with these solder connections, which are described, for instance in WO 98/34263. These complicated solder connecting techniques can be dispensed with. The fuse element in accordance with the invention may be manufactured economically.

In a preferred embodiment of the fuse element, a conductive adhesive is introduced at least between the end sections of the conductor and the side walls of the contact caps. In this embodiment, the adhesive connection serves not only to mechanically fix the fusible conductor but also simultaneously to form an electrical contact. The mechanical fastening of the contact cap to the hollow body is preferably also produced with the aid of a conductive adhesive. This avoids a connection of the contact caps based substantially on a frictional lock with the high mechanical stressing associated therewith both of the caps and also of the hollow bodies (e.g. small ceramic tubes). This fastening technique also renders possible a relatively large clearance between the inner surfaces of the cap and the outer surface of the hollow body. This in turn enables the introduction of thicker fusible conductive wires with a higher conductivity. When manufacturing the fusible conductive element, in order to achieve sufficient conductor lengths (i.e. a sufficient ohmic resistance), the thicker fusible conductive wires are wound more densely about an (optimally thicker) core, which can again result (advantageously) in a more slowly blowing element.

The adhesive connections preferably have an adhesive resistant in the set state to 200° C., preferably to 280° C. This improves the installation possibilities of the fuse element, since thermal loading into these temperature ranges, as can occur in soldering processes (e.g. SMD), is rendered possible.

One embodiment of the fuse element is characterised in that the side walls of each contact cap overlap the outer surface of the wall of the hollow body in a section which extends over the entire periphery of the hollow body. The adhesive connections preferably then extend over the entire periphery of the hollow body. This enables hermetic sealing of the void in the hollow body and thus, if the process is suitably conducted, evacuation or filling of the void with an inert or arc-quenching or arc-inhibiting gas.

In a preferred embodiment of the invention, the fusible conductive element extends in the void between the two end faces of the hollow body such that it contacts the inner surface of the wall only in the vicinity of the end faces. The fusible conductive element preferably extends diagonally in the void between the two end faces of the hollow body. This creates a minimum contact area between the fusible conductor and the inner wall of the hollow body at maximum length of the fusible conductive element and thus defined environmental conditions of the fusible conductor. The fusible conductor element preferably has a fusible conductor (wire), wound about an elongate carrier, the elongate carrier extending between the two end faces of the hollow body, the fusible conductor being wound around the carrier over its entire length. The thermal conditions created by the winding of the fusible conductor about a carrier (or core) result in a more inert characteristic of the fuse element, which is desired in many application. For instance, sections of the wound fusible conductor are preferably partially withdrawn from end sections of the carrier and passed out of the void around the wall of the hollow body. This simplifies the manufacture of the contacts and the fastening of the fusible conductive elements.

In a preferred embodiment of the fuse element, the hollow body comprises an $AL_2O_3$ ceramic material containing ZrO (so called ZTA ceramic). The ceramic material preferably contains 80-98% $Al_2O_3$ and 2-20% ZrO, particularly 90-95% $Al_2O_3$ and 5-10% ZrO. Such a hollow body reduces the risk of the fuse element bursting since it exhibits no crack formation enabling bursting even at the high thermo-mechanical stressing which occurs as a result of an arc ignited in the void in the hollow body.

In another preferred embodiment of the fuse element, the bases of the contact caps each have a thickness of 0.25-1 mm, preferably 0.35-0.45 mm, and the adjoining side walls have a thickness which is smaller by a factor of 1.5-4, preferably by a factor of 2-3. This enables adequate protection against an arc ignited in the void burning through the base of the contact cap with a mechanical strength of the cap side walls which is still sufficient and serves to save material. Such a cap can advantageously be produced in a deep drawing process.

A preferred embodiment of the manufacturing method in accordance with the invention is characterised in that the adhesive is supplied by removing a first amount from an adhesive reservoir and applying it at a first adhesive point to an end section of the conductor and a second amount is removed from the adhesive reservoir and applied at a second adhesive point to the other end section of the conductor.

Advantageous and preferred embodiments of the invention are characterised in the dependent claims.

BRIEF DESCRIPTION OF THE DRAWINGS

The invention will be described below with reference to a preferred embodiment illustrated in the drawings, in which.

DETAILED DESCRIPTION OF THE INVENTION

Figure 1:
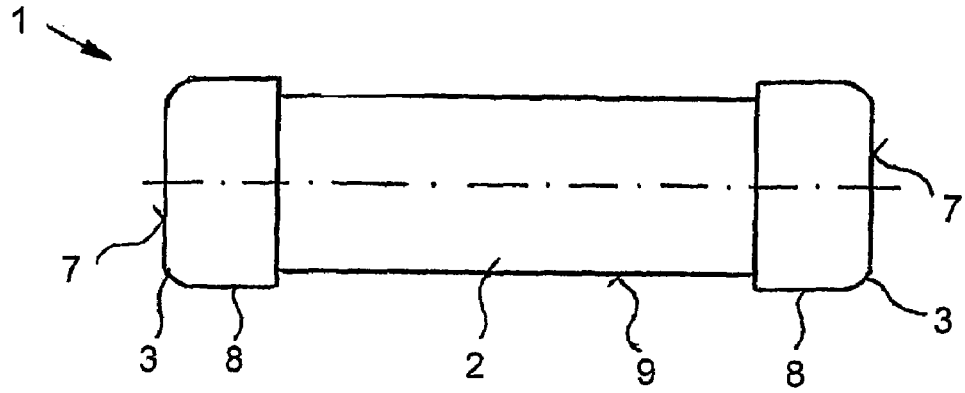
FIG. 1 is a side view of one embodiment of the fuse element in accordance with the invention.

The preferred embodiment of the fuse element 1 illustrated in FIG. 1 comprises a small ceramic tube 2, positioned on the two ends of which there is a respective contact cap 3 and in whose interior (not shown in FIG. 1) extends a fusible conductive element. The fuse element 1 has, for instance, a length of about 10 mm and a diameter of about 2-3 mm. The small ceramic tube preferably has a cross-section, the outer contour of which constitutes a square with rounded corners. The positioned caps 3 have a respective base 7 and adjoining side walls 8, the shape of the caps 3 preferably being matched to the square outer contour of the small ceramic tube 2. In particular, the inner contour of the side walls 8 of the cap 3 is preferably matched to the contour of the outer area of the small tube 2 such that a gap is produced between the outer surface 9 and the cap walls 8.

Figure 2:
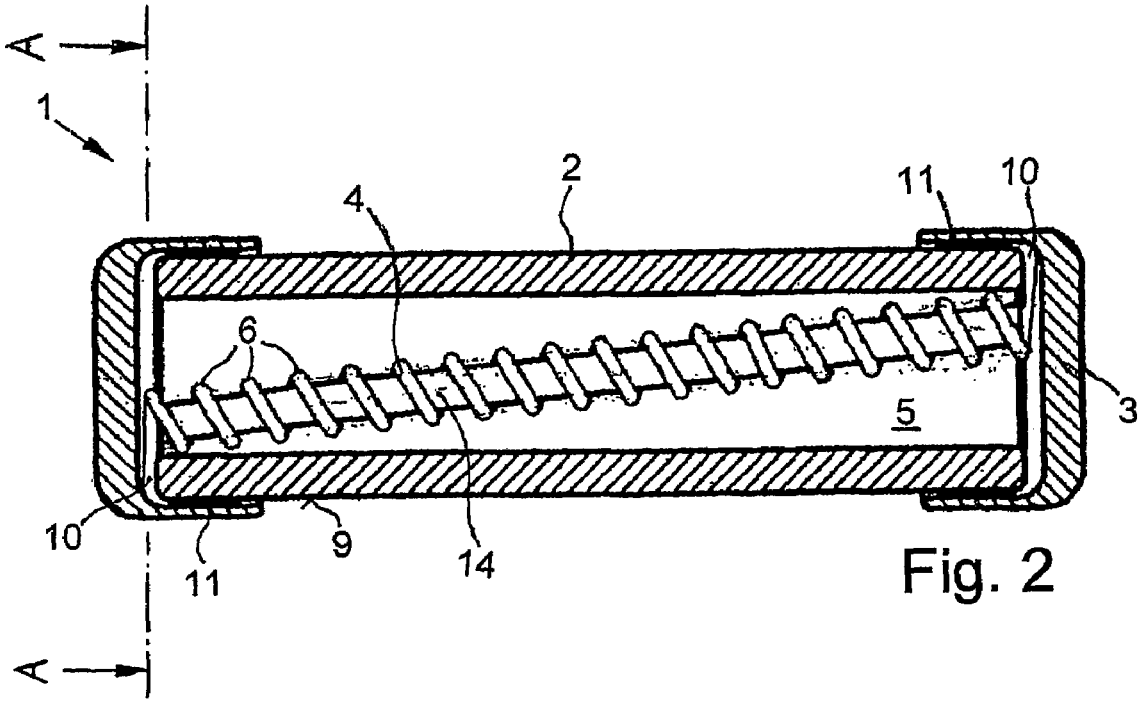
FIG. 2 is a longitudinal sectional view of the fuse element shown if FIG. 1.
Figure 3:
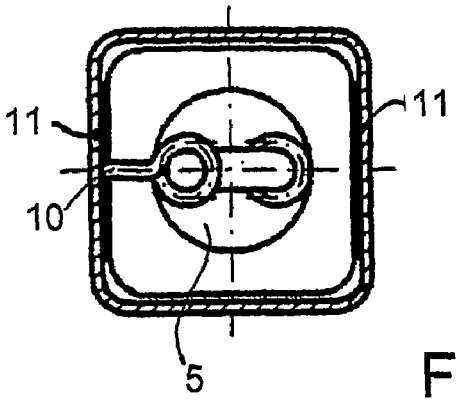
FIG. 3 is a cross sectional view of the fuse element shown in FIG. 2.

FIG. 2 is longitudinal sectional view through the fuse element shown in FIG. 1. FIG. 3 is a cross-sectional view, the section passing through the gap between a base of a contact cap 3 and an end face of the small ceramic tube 2. Further details of the preferred embodiment of the fuse element in accordance with the invention will be described below with reference to FIGS. 2 and 3.

The small ceramic tube 2 with a square external shape has a void 5 constituted by a circular elongate bore. The void 5 is defined by the inner wall of the small ceramic tube 2 and the two open end faces. Extending within the void 5 between the two end faces there is a fusible conductive element 4. In the preferred embodiment, the fusible conductive element 4 includes a fusible conductor 6 wound around a core 14. The fusible conductor is preferably a thin wire, which can contain, for instance, the metals silver, copper, zinc, tin and/or lead. The fusible conductive wire 6 can consist of a substantially pure metal or an alloy of the aforementioned metals. Furthermore, it can also be constructed of layers of different materials. For instance, the fusible conductive wire 6 can be an externally silvered copper wire, which results in a more inert behavior of the fuse element 1 by comparison with a homogeneous wire, as a result of changes in the specific resistance accompanying metal diffusion effects. The core 14 of the fusible conductive element 4 consists, for instance, of a glass fibre strand.

The fusible conductive element 4 preferably has a fusible conductive wire 6, which extends over the entire length of the fusible conductive element 4 and also extends out of the void 5 of the small ceramic tube 2 through the end faces around the edge of the small ceramic tube 2 so that it engages the outer surface 9 of the small ceramic tube 2 at both ends. The fusible conductive element 4 includes no internal solder connections and no supply wire sections secured at the ends of the fusible conductive wire.

Fusible conductive wires 6 of different thickness are preferably used for different rated currents of the fuse element. For instance, the fusible conductive wire has a diameter of ca. 0.03-0.075 mm for a rated current of 500 mA, a diameter of ca. 0.09-0.12 mm for a rated current of 1.25 A and a diameter of ca. 0.12-0.16 mm for a rated current of 2 A.

In one embodiment, the fusible conductive wire 6 is wound around the core 14, at least in the central region of the fusible conductive element 4, with uniform spacings of the wire turns. A spacing which results in an occupation density of 25-75% is preferred. The occupation density influences the inertia of the characteristics of the fuse element.

In alternative embodiments of the fuse element 1 in accordance with the invention, instead of the wound fusible conductor, a fusible conductive wire extending in a straight line through the void 5 in the small tube 2 could be used.

The two contact caps are preferably produced from copper or a copper-containing alloy, for instance a copper-zinc alloy (brass). Alternatively, the caps could also be made from materials with arc-cooling characteristics, such as titanium. The caps 3 could also have a multi-layer construction. Furthermore, a small plate covering the end face could be inserted into the void between the base 7 of the cap 3 and the end face of the small ceramic tube 2, whereby the small plate could consist of a material with arc-cooling properties.

In the preferred embodiment of the fuse element 1, the caps 3 have bases 7, which are relatively thick in comparison to the walls 8. The bases 7 have a thickness which can resist burning through by an arc formed in the void 5. The bases 7 of the caps 3 preferably have a thickness of 0.25-1 mm, in particular 0.4 mm. The thickness of the side walls can be substantially smaller, since the side walls are neither exposed to arcs nor subjected (as a result of the preferred adhesive connection) to relatively large mechanical loads. The thickness of the side walls 8 is preferably 0.1-0.3 mm, particularly about 0.2 mm. The thin side walls result not only in a saving of materials but also in minimal external dimensions of the fuse element with the given dimensions of the small tube. The caps are preferably integral and produced, for instance, by a deep drawing process.

The internal dimensions of the caps 3 are so selected that, after pushing the caps 3 onto the small ceramic tube 2, a gap remains between the internal walls of the caps 3 and the external surface 9 of the small ceramic tube 2. The remaining gap is sufficiently wide to accommodate the (relatively thick) wire ends of the fusible conductor 6. This renders the manufacturing process in accordance with the invention of the fuse element described below possible.

In one embodiment of the fuse element 1 in accordance with the invention, the internal space 5 can be wholly or partially filled with a filling medium. An arc-inhibiting material is preferably used as the filling medium. This reduces the risk of undesired arc formation yet further. The internal space 5 is filled, for instance, with sand. If, as in the preferred embodiment, the contact caps 3 are so constructed that a narrow gap remains between the contact caps 3 and the outer surface 9 of the small ceramic tube 2, the grain size of the filling medium is so selected that it can not escape from the internal space 5.

In order to manufacture the fuse element, the small ceramic tube 2 and a core 14 with the fusible conductive wire 6 wound around it are firstly made available. The core 14, with the fusible wire 6 wound around it, is preferably cut off for this purpose from a longer prefabricated glass fibre strand around which wire is wound, whereby a section is made available with a length which corresponds approximately to the length of a diagonal in the internal space 5 within the small ceramic tube 2. When the section of the glass fibre strand with wire wound around it is inserted, at both ends of the section, a respective predetermined end section 10 of the fusible conductive wire 6 is pulled out, whereby one pulled out end 10 of the wire is firstly wound around one end of the small tube 2 and then the other wire end 10 is wound around the wall of the small tube 2 at the other end and is fixed in position on the periphery 9 of the small ceramic tube 2. The wire ends 10 are fixed in position by applying a predetermined amount of a conductive adhesive. The two wire ends 10 are preferably fixed in position approximately in the centre of one of the outer four outer surfaces 9 of the small ceramic tube 2, whereby the opposite wire ends 10 are fixed in position on opposing outer surfaces of the small ceramic tube 2. Further predetermined amounts of the adhesive can additionally be applied at each of the two ends of the small ceramic tube 2 in the section, which is subsequently to be covered by a respective contact cap 3. The adhesive is preferably applied at each end of two opposing points on the four outer surfaces of the small ceramic tube 2. In alternative embodiments, the adhesive can be applied only at the point in which the wire ends 10 are fixed in position or to three or all four outer surfaces, whereby the adhesive can be applied only centrally or along the entire periphery of the small ceramic tube. On the one hand, the amount of adhesive used may thus be varied; on the other hand, either a hermetic seal of the connection between the cap 3 and the small ceramic tube 2 is possible or selectively leaving an air gap open between the outer wall 9 of the small ceramic tube 2 and the inner wall of the contact cap 3. The application of the conductive adhesive to only two opposing points at both ends of the small ceramic tube 2, i.e. at a total of four points on the outer surface 9 of the small ceramic tube 2, simplifies the manufacture and reduces its costs. It has transpired in tests that, for the creation of the desired characteristics of the fuse element, particularly for the creation of an adequate surge resistance, it is substantially not necessarily to seal the internal space of the fuse element 1 hermetically. The creation of a gap-shaped passage between the internal space 5 and the environment renders possible, on the other hand, the advantage of producing a pressure relief passage, which reduces the risk of an explosion of the fuse element 1 under the pressure rise associated with the vaporization of the fusible wire 6 and the formation of an arc.

After applying the predetermined amount of adhesive and before the setting or hardening of the adhesive, the contact caps 3 are pushed onto the ends of the small ceramic tube 2. The dimensions of the gap produced between the inner walls of the caps and the small ceramic tube and the amount of adhesive applied are so selected that a reliable adhesive connection is produced between the contact caps 3 and the small ceramic tube 2 and a good electrical contact between the wire ends 10 and the contact caps 3. The adhesive filling formed in the gap is designated with the reference numeral 11 in FIGS. 2 and 3. It may be seen in FIGS. 2 and 3 that, in the illustrated preferred embodiment, a total of four opposing regions of the gap are produced, which are filled with the adhesive 11.

In order to manufacture the fuse element, it is possible, on the one hand, initially to apply the adhesive to both ends of the small ceramic tube 2 and then subsequently to position the two contact caps 3; it is also possible, on the other hand, initially to apply the adhesive to one end of the small ceramic tube 2 and to position a first contact cap 3 and subsequently to repeat the same procedure at the other end of the small ceramic tube.

If the internal space 5 of the fuse element is to be filled with a filling medium, for instance an arc-inhibiting material, the contact cap 3 is advantageously initially positioned on one end, the internal space 5 subsequently filled with the filling medium and then the second contact cap positioned.

The adhesive which is used can be a single component adhesive or a multi-component adhesive. In the latter case, the components can be mixed before application to the small ceramic tube or the components can be applied individually and, for instance, in layers to the small ceramic tube 2. A multi-component resin is preferably used which contains a sufficient amount of conductive particles to produce electrical conductivity, for instance an epoxide resin with an admixture of silver and/or nickel particles. As regards the adhesive, a commercially available organic multi-component adhesive is preferably used. Alternatively, an inorganic adhesive or cement could, however, be used, which possesses the necessary electrical conductivity. An adhesive can be used (for instance a multi-component resin), which sets on its own after application within a predetermined time and optionally in a predetermined surrounding atmosphere. Alternatively, an adhesive can also be used in which the fuse element must be subjected to a particular treatment, for instance post-curing, in order to harden the adhesive.

When applying the adhesive to the outer surface 9 of the small ceramic tube 2 and subsequently positioning the contact caps 3, care is preferably taken that the adhesive is so distributed within the gap-shaped space between the contact cap 3 and the small tube 2 that as small as possible an amount of the adhesive 11 gets onto the end face of the small ceramic tube and into the internal space 5. Organic materials should thus be avoided in accordance with the invention in the internal space 5 of the fuse element 1. This reduces the risk of the maintenance and formation of an arc after rupturing of the fusible conductor when a high voltage is applied to the contact caps 3. The presence of organic materials in the internal space 5 would result, by reason of the production of the arc directly after the rupture of the fusible conductor, in carbon deposits being formed on the surfaces in the internal space 5. These constitute conductive regions which facilitate the formation or reformation of arcs. Furthermore, when the arc acts on organic adhesive residues, gaseous hot reaction products can form, which promote an explosion of the fuse element. This is avoided by the fastening in accordance with the invention of the fusible conductor ends 10 and contact caps 3 at the ends of the small ceramic tube 2.

The fastening in accordance with the invention also avoids the necessity of solder connections to produce electrical contacts between the ends 10 of the fusible conductor and the contact caps 3. The production of the solder connections previously required the use of fluxes, which in turn resulted in organic deposits within the internal space 5 of the fuse element. As a result of the fastening of the fusible conductor ends and contact caps in accordance with the invention, the use of a flux-free soldering process is no longer necessary, so that a relatively economical fuse element can be produced.

Fuse elements of the type in accordance with the invention are suitable, in particular, for the fuse protection of telecommunication lines against excessive currents. The fuse element is connected, for instance, between the end of a telecommunications wire line and an input connection of a telecommunications device. An over-voltage protector is also connected between the input of the telecommunications device and ground (earth), i.e. a component whose resistance assumes a minimal value when a predetermined (high) trigger voltage at its connections is exceeded. This circuit arrangement produces particular requirements on the fuse element. If, for instance, high voltage pulses appear on the telecommunications line, relatively high current pulses are produced as a result of the reduced resistance of the over-voltage protection element, which are conducted through the fuse element. The fuse element should not be ruptured (melted) by these current pulses, which are based on voltage spikes on the telecommunications line and whose length is generally shorter than one second. On the other hand, the fuse element should reliably blow at current intensities, which are more than an order of magnitude less than the current intensities of these pulse loads but are a few multiples of the rated current, if these (lower) currents flow for a relatively long period of time. This means that the fuse element should have a very inert characteristic. Furthermore, there are additional requirements on the fuse element which relate to the speed and nature of the tripping (melting) of the elements under predetermined extreme conditions. For instance, the fuse element should be able to resist brief current spikes with very high currents (for instance >10 A) but trip (rupture) in any event before the telecommunications line can suffer damage. In order to test the requirements on the fuse elements, predetermined conditions, which could arise in operation, are simulated in standardised tests. One of these tests relates, for instance, to the pulse resistance; in this test, current pulses of up to 1000 US duration and peak currents of, for instance, 100 A are produced a number of times successively at voltages of, for instance 1000 volts. The fuse element must withstand these tests. In other tests, the telecommunications line is simulated, for instance by a so called "line simulator", which is connected in series with the fuse element. This series circuit is subjected to voltage/current pulses of, for instance, 600V/60 A for a duration of, for instance, 5 seconds. The fuse element must in any case melt before the line simulator is damaged.

The fuse element in accordance with the invention satisfies the aforementioned operating or test requirements, which apply, in particular, to telecommunications requirements, in an excellent manner. As a result of the combination of a fusible conducive element with a relatively thick and wound fusible wire with an internal space of the fusible conductive element, which is substantially free of organic materials and solder connections, both the adequate pulse resistance (adequate inertia) and also reliable tripping under extreme conditions, which could destroy the telecommunications line, are ensured.

The invention claimed is:

1. A method of manufacturing a fuse element including the following sequential steps:

providing a hollow body, which is constituted by a tubular wall surrounding an internal space and has two opposing open end faces, introducing a fusible conductive element into the internal space of the hollow body such that the fusible conductive clement extends substantially from one end face to the other, passing two end sections of a conductor of the fusible conductive element out of the internal space through the end faces around the wall of the hollow body such that they are disposed externally at a respective adhesive point on the outer surface of the hollow body, applying a conductive adhesive at least to the two adhesive points on the outer surface of the hollow body such that a respective portion of the end sections of the conductor of the fusible conductive element is also wetted, positioning two contact caps with a respective base and adjoining side walls on the hollow body such that the bases of the two contact caps at least partially close the internal space at the end faces and the side walls overlap a respective section of the outer surface of the wall of the hollow body, the sections enclosing the two adhesive points and so that an air gap is left between the outer surface of the wall of the hollow body and at least one of the side walls of the contact caps for providing fluid communication between the internal space of the hollow body and an environment surrounding the hollow body, said step of applying the adhesive to the outer surface of the hollow body and the following step of positioning contact caps are carried out so that the adhesive is distributed between the contact cap and the hollow body such that substantially no adhesive gets onto the end faces of the hollow body and into the internal space, setting the adhesive, whereby the end sections of the conductor of the fusible conductive element are secured outside the internal space in a gap-shaped space defined between the outer surface and side wall such that the surfaces adjoining the internal space are maintained substantially free of organic materials.

2. A method as claimed in claim 1, characterized in that a conductive adhesive is introduced, at least between the end sections of the conductor and the side walls of the contact caps.

3. A method as claimed in claim 1, characterized in that the adhesive is applied by removing a first amount from an adhesive reservoir and applying it to a first adhesive point on an end section of the conductor and removing a second amount from the adhesive reservoir and applying it to a second adhesive point on the other end section of the conductor.

4. A method as claimed in claim 1, characterized in that the fusible conductive element is introduced into the internal space of the hollow body such that it contacts the inner surface of the wall only in the vicinity of the end faces.

5. A method as claimed in claim 1, characterized in that a fusible conductive element is introduced, which has a fusible conductor wound around an elongated carrier, the fusible conductor having been wound about the entire length of the carrier, that sections of the wound fusible conductor are pulled away from end sections of the carrier during or after introduction of the fusible conductive element, and that the pulled away sections of the wound fusible conductor are passed out of the internal space around the wall of the hollow body.

6. A method as claimed in claim 1, characterized in that the hollow body comprises a shape of a square with rounded corners on the outer surface and the inner space comprises a cylindrical bore.

* * * * *